US008366255B2

(12) United States Patent
Marwah et al.

(10) Patent No.: US 8,366,255 B2
(45) Date of Patent: Feb. 5, 2013

(54) SOLID INK STICK WITH RETRIEVAL FEATURE

(75) Inventors: Rahul R. Marwah, Portland, OR (US); Jonathan R. Ritter, Wilsonville, OR (US); Brian Walter Aznoe, Sherwood, OR (US); Christopher R. Gold, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 174 days.

(21) Appl. No.: 12/791,908

(22) Filed: Jun. 2, 2010

(65) Prior Publication Data

US 2011/0298874 A1 Dec. 8, 2011

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS 6,672,716 B2 * 1/2004 Jones ..... 347/88
6,929,360 B2 8/2005 Jones
6,986,570 B2 * 1/2006 Jones et al. ..... 347/88
7,063,412 B2 6/2006 Jones et al.
2003/0202066 A1 10/2003 Jones
2003/0202076 A1 10/2003 Jones et al.
2003/0202078 A1 10/2003 Jones et al.
2007/0296779 A1 12/2007 Tidrick
2007/0296782 A1 12/2007 Jones et al.
2007/0296783 A1 12/2007 Jones
2008/0036836 A1 2/2008 Chambers et al.
2008/0218569 A1 9/2008 Esplin et al.
2008/0225096 A1 9/2008 Jones et al.
2009/0091609 A1 4/2009 Jones et al.

* cited by examiner

*Primary Examiner* — Matthew Luu
*Assistant Examiner* — Rut Patel
(74) *Attorney, Agent, or Firm* — Fay Sharpe LLP

(57) ABSTRACT

A solid ink stick for use in an imaging device, such as a phase change inkjet printer, is provided. The solid ink stick has a retrieval feature located on a top surface thereof. When the ink stick is incorrectly loaded through the insertion opening of a feed channel of the printer, the retrieval feature has a vertical dimension such that the ink stick can be grasped, such as by two fingers of a user, to remove the ink stick through the insertion opening. The retrieval feature generally includes two lower surfaces interconnected with at least one upper surface.

12 Claims, 7 Drawing Sheets

SOLID INK STICK WITH RETRIEVAL FEATURE

BACKGROUND

The present disclosure relates to one or more features on the surface, such as the top surface, of a solid ink stick that increase the ease of removal of an ink stick from an ink feed channel of an imaging device.

Certain imaging devices, such as solid ink or phase change ink printers, conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

The correct loading and feeding of ink sticks has typically been accomplished by incorporating keying, guiding, alignment, or orientation features into the exterior surface of an ink stick. These keying features are protuberances or indentations that are located in different positions on an ink stick. Corresponding keys or guide elements on the perimeters of the insertion openings exclude ink sticks which do not have the appropriate perimeter key elements, and also ensure that the ink stick is properly aligned and oriented in the feed channel. These keying features are particularly important for color printers, which typically use four different colors of ink (cyan, yellow, magenta, and black).

The physical configuration of the ink stick generally provides all of the uniqueness to determine whether the ink stick is in the proper feed channel. However, this system is not foolproof, largely because the keying features are not extreme in their depths to avoid mass loss and reduce the vulnerability of the ink stick to fracture. Because the keying features are moderate and can be very similar across multiple product lines, incorrect insertions can occur. For example, because cyan, magenta, and black ink sticks are somewhat similar in color, they can be easily loaded into the incorrect feed channel. Even if an ink stick is placed in the correct feed channel, the ink stick may not be correctly oriented. An incorrectly oriented ink stick may not feed properly along the feed channel and/or may not engage the ink melter appropriately. In addition, encoding features on an ink stick that has been incorrectly oriented may not be positioned optimally in the feed channel to interact with sensors, resulting in faulty actuation of the sensors or no actuation at all. This causes a need to remove the ink stick out of the feed channel through the insertion opening.

Insertion openings typically offer very small clearances, and ink sticks are not generally shaped to enhance retrieval. U.S. Pat. No. 6,929,360 describes one method of retrieving an ink stick. The insertion opening itself is shaped to both provide guide elements and to provide a clearance space through which a tweezer-like removal tool can be inserted to grasp the ink stick and pull the ink stick through the insertion opening.

It would be desirable to provide an ink stick with integrated retrieval features, allowing the ink stick to be removed through the insertion opening with the human hand alone, i.e. without the need for additional tools.

BRIEF DESCRIPTION

Disclosed, in various embodiments, are solid ink sticks suitable for use in phase change inkjet printers. The ink sticks have bodies that include a retrieval feature which allows the ink stick to be removed through the insertion opening of the printer with the human hand alone.

Disclosed in embodiments is an ink stick configured to be removable from the feed channel of an associated imaging device. The ink stick comprises an ink stick body having a top surface, a bottom surface, a front surface, a rear surface, and two side surfaces. A retrieval feature is located along the top surface, the retrieval feature having a vertical dimension sufficient to permit the retrieval feature to be grasped between two fingers.

The retrieval feature may be located along a central portion of the top surface.

In some embodiments, the retrieval feature is formed by a stem extending above the top surface for the vertical dimension.

In other embodiments, the retrieval feature is formed by a first recess in the top surface and a second recess in the top surface, the first recess and the second recess having opposing grasping surfaces and extending into the top surface for the vertical dimension. In more specific embodiments, the first recess and the second recess each taper from the vertical dimension in a central portion of the top surface to the top surface in a longitudinal direction.

The vertical dimension may be a distance of at least 6 mm.

In additional embodiments, the retrieval feature comprises a first lower surface, a second lower surface, and an upper surface located between the first and second lower surface.

The retrieval feature may alternatively comprise four conjoining vertical faces.

Sometimes, the retrieval feature is spaced at least 5 mm away from the front surface, the rear surface, and the two side surfaces.

At least one of the side surfaces may include a key element which interacts with an associated printer to indicate whether the ink stick should be inserted into a particular feed channel of the printer. The front surface and the rear surface could also have complementary interlocking shapes.

In certain embodiments, the retrieval feature is formed by a first recess in the top surface and a second recess in the top surface, the first recess and the second recess each extending into a central portion of the top surface for the vertical dimension and tapering towards the top surface in a longitudinal direction, the vertical dimension being at least 6 mm.

Also disclosed in other embodiments is an ink stick configured to be manually removed from the feed channel of an associated ink printer. The ink stick comprises an ink stick body having a top surface. A retrieval feature is located along the top surface, the retrieval feature comprising two opposing faces that have a vertical dimension sufficient to permit the retrieval feature to be grasped between two fingers.

The two opposing faces may extend into the ink stick body from the top surface. Alternatively, the two opposing faces may extend from the top surface away from the ink stick body.

The retrieval feature may further comprise an upper surface joining the two opposing faces. Alternatively, the two opposing faces are angled at least 5° from a vertical axis.

Also disclosed is a method of manually removing an ink stick from a feed channel of an associated ink printer. An ink stick is inserted through an insertion opening into the feed channel. Two fingers are extended through the insertion opening to grasp a retrieval feature along a top surface of the ink stick, the retrieval feature having a vertical dimension sufficient to permit the retrieval feature to be grasped between two fingers. Finally, the ink stick is pulled through the insertion opening to remove the feed stick from the feed channel.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
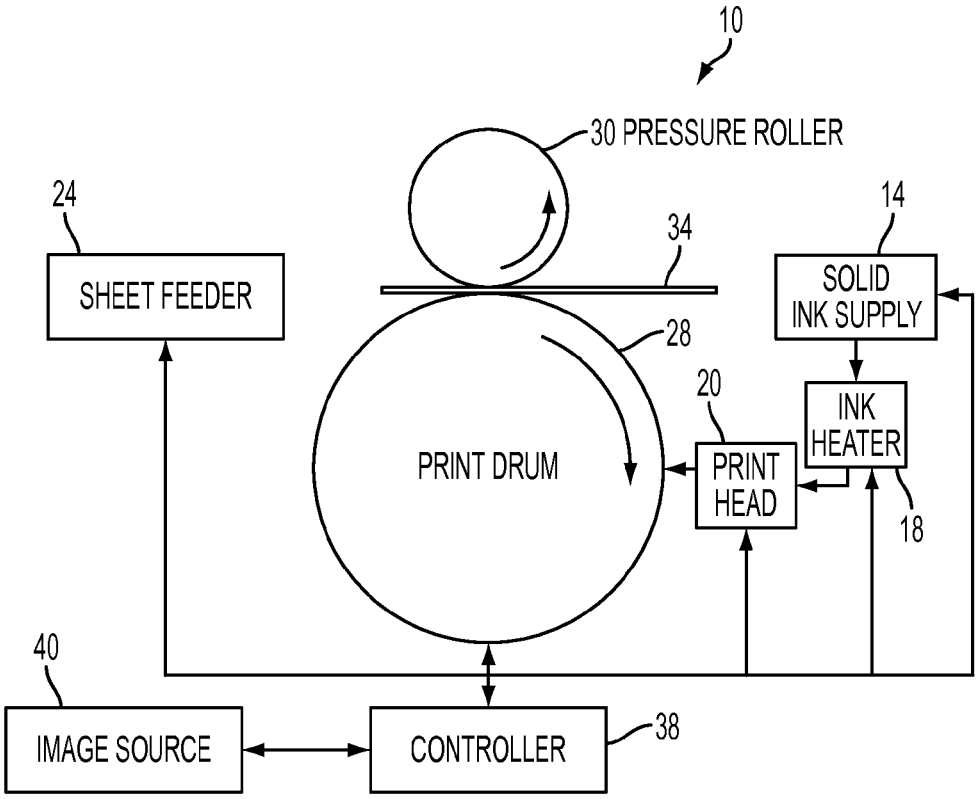
FIG. 1 PRIOR ART
FIG. 1 is a block diagram of a phase change ink printer.

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10."

The term "printer" refers to devices which can reproduce images, such as printers, fax machines, copiers, and related multi-function printers.

Referring now to FIG. 1, there is illustrated a block diagram of an embodiment of a conventional offset-type phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment shown in FIG. 1 is of an offset printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling many or all of the other machine subsystems and functions, including the machine's printing operations, and, thus, includes the necessary hardware, software, etc. for controlling these various systems.

Figure 2:
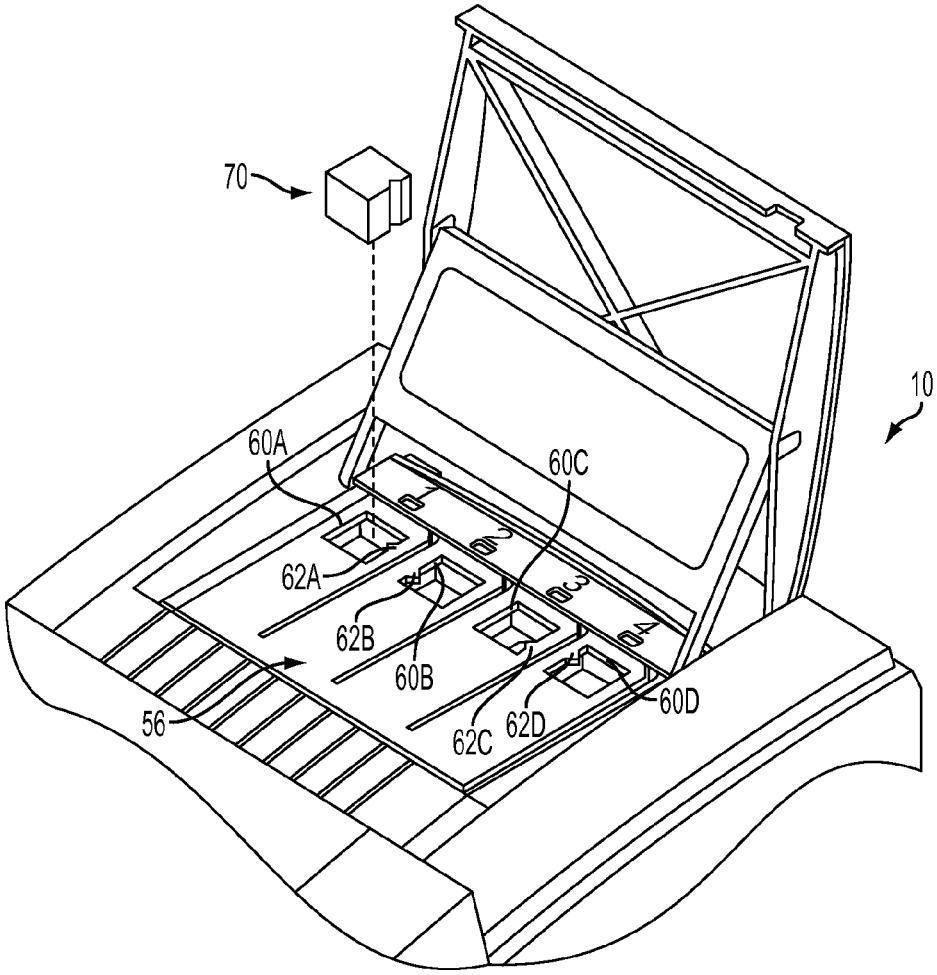
FIG. 2 is a partial top perspective view of a phase change ink printer with an ink access cover in the open position, showing where a solid ink stick can be loaded into a feed channel.

FIG. 2 provides a top view of the loading station 50 of a printer 10. A key plate 56 has four keyed openings 60A, 60B, 60C, 60D, one for each color. Each keyed opening provides access to a feed channel 58 of the solid ink feed system (not shown here). Each keyed opening has a key structure 62A, 62B, 62C, 62D that interacts with the ink stick 70 so that only those ink sticks having a complementary key element can be inserted into a particular keyed opening.

Figure 3:
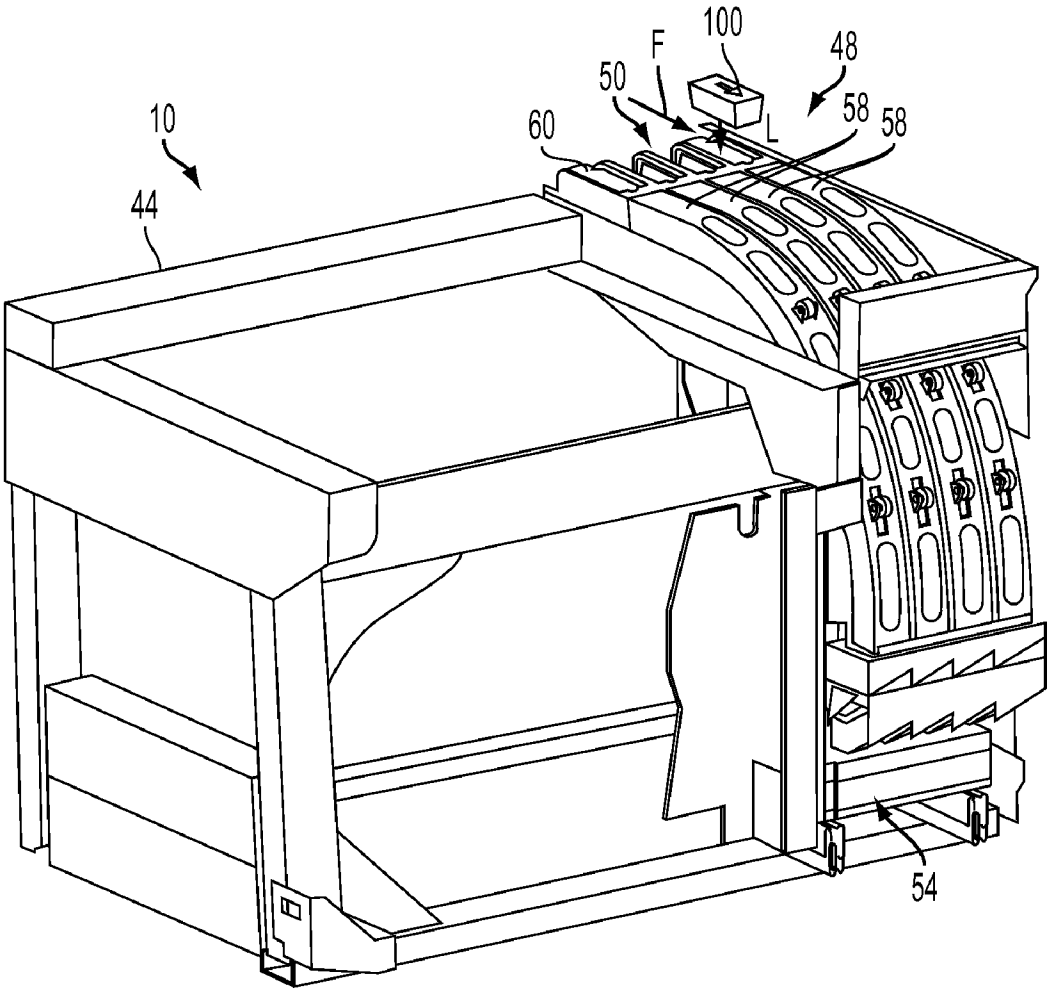
FIG. 3 is a perspective view of the feed channels of a solid ink stick feed system of a phase change ink printer.

Referring now to FIG. 3, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

As shown in FIG. 3, the loading station 50 receives ink sticks inserted through the keyed openings 60 in an insertion direction L. The feed channels are configured to transport ink sticks in a feed direction F from the loading station to the melting station. Here, the insertion and feed directions L, F are different. For example, ink sticks may be inserted in the insertion direction L and then moved along the feed channel in the feed direction F. In alternative embodiments, the feed channels and keyed openings may be oriented such that the insertion and feed directions L, F are substantially parallel.

Figure 4:
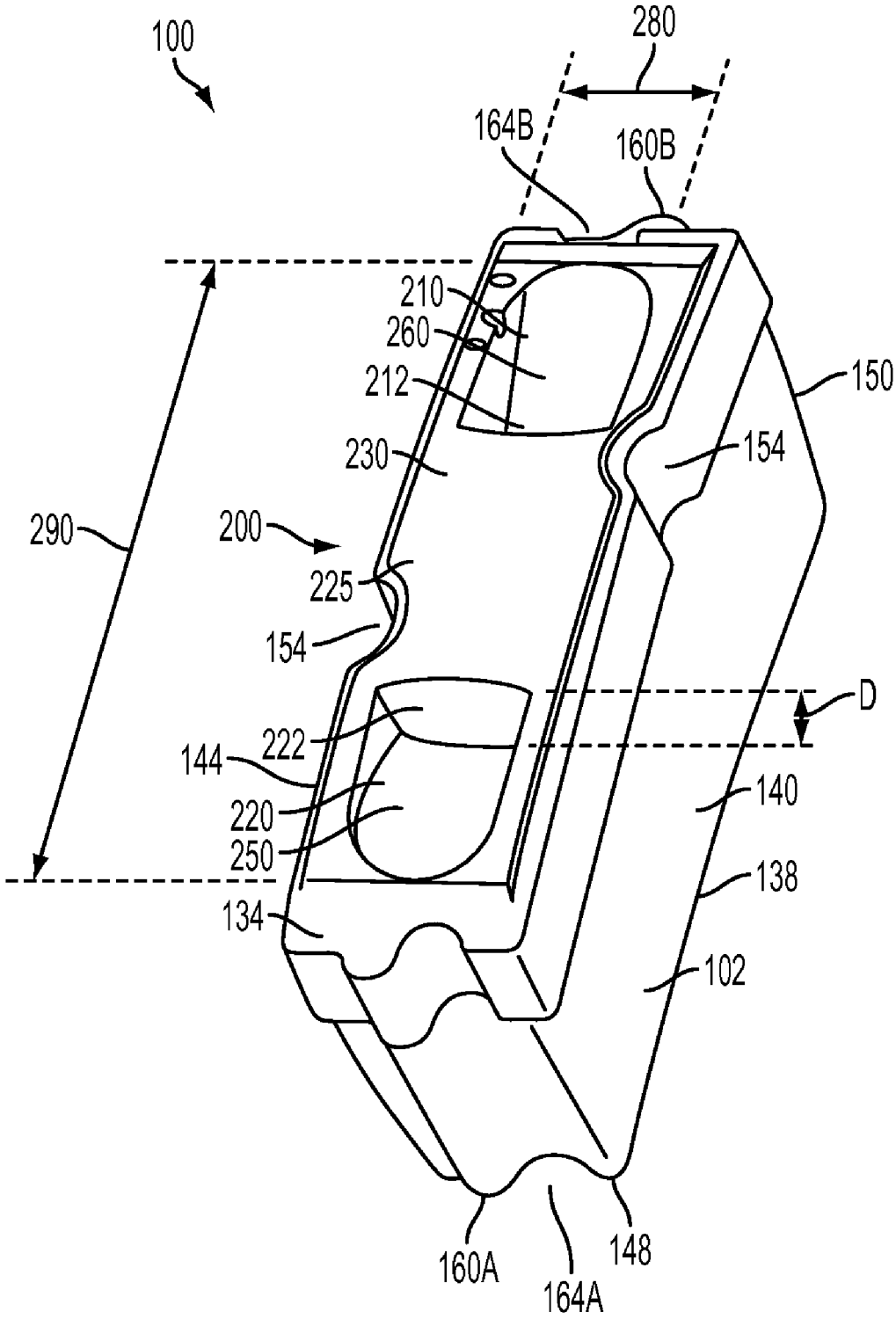
FIG. 4 is a top perspective view of an exemplary embodiment of a solid ink stick having a retrieval feature.
Figure 5:
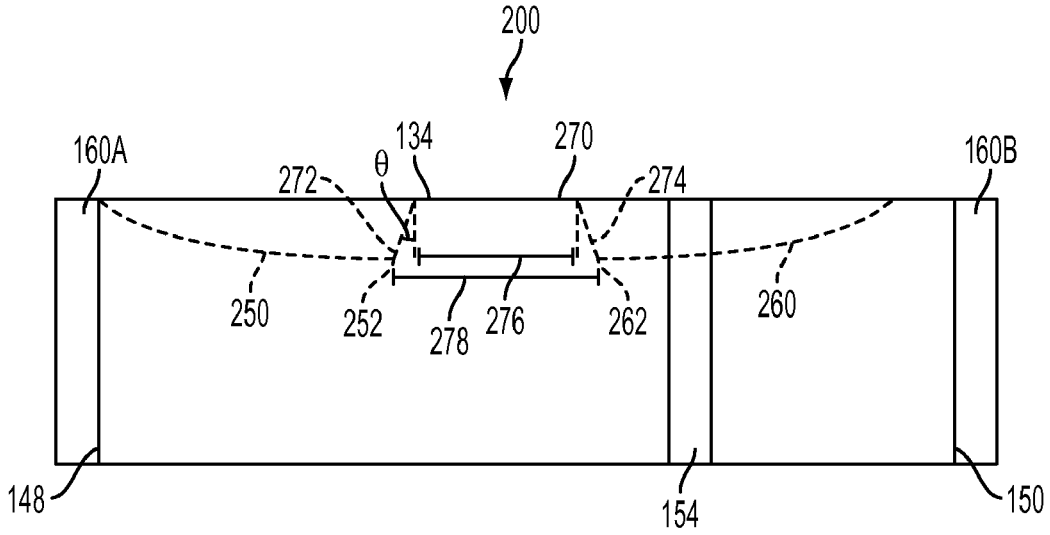
FIG. 5 is a side view of the exemplary ink stick shown in FIG. 4.

An ink stick may take many forms. One exemplary solid ink stick 100 for use in the ink delivery system is illustrated in FIG. 4 and FIG. 5. The ink stick body 102 has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has side surfaces 140, 144, a front surface 148, and a rear surface 150. The side surfaces 140 and 144 are substantially parallel to each other, and are substantially perpendicular to the top and bottom surfaces 134, 138. The front and rear surfaces 148, 150 are also basically substantially parallel to each other, and substantially perpendicular to the top and bottom surfaces, and to the side surfaces. The front surface 148 may be considered a leading end surface, and the rear surface 150 can be considered a trailing end surface. The ink stick body may be formed by pour molding, injection molding, compression molding, or other known techniques. Generally, the ink stick body is generally homogeneous throughout, and is formed from a composition comprising printing ink.

The ink stick 100 may incorporate interlocking features on the front and rear surfaces 148, 150 to ensure reliable movement of the ink sticks along the feed channel. Put another way, the front and rear surfaces 148, 150 may have complementary interlocking shapes. As seen in FIG. 4, front surface 148 has a vertically extending ridge or protrusion 160A positioned adjacent a vertically extending recess 164A to form a substantially S-shaped contour. Similarly, rear surface 150 has a vertically extending ridge or protrusion 160B positioned adjacent a vertically extending recess 164B to form a substantially S-shaped contour. It should be noted that the front and rear surfaces do not need to be planar, and are not planar in this embodiment. The position of the ridge 160 of the interlocking feature at one end of the ink stick mirrors the position of the recess 164 at the opposite end of the ink stick and vice versa. This configuration allows adjacent ink sticks to abut, or nest, in a feed channel. Interlocking ink sticks in a feed channel provide the benefit of limiting lateral movement of the ink sticks relative to one another. By limiting movement of the ink sticks with respect to one another, the tendency for ink sticks to become skewed with respect to each other, or with respect to the feed channel, is mitigated or eliminated as the ink sticks travel along the feed path.

In addition, these complementary interlocking features at the ends of the ink stick allows the formation of a reversible ink stick, or, in other words, an ink stick that may be inserted through complementarily shaped keyed openings without regard to which end of the ink stick is forward. To facilitate reversible insertion, the ink stick may include reversible key elements along the side surfaces 140, 144 of the ink stick. For example, key element 154 could be located along side surface 140 substantially the same distance from rear surface 150 as the distance between key element 154 located along side surface 144 from front surface 148. In other words, the ink stick is configured such that it exhibits 180° rotational symmetry. Thus, reversible ink sticks may be inserted into a complementarily shaped keyed opening of an ink loader in at least two orientations, i.e. either front surface 148 or rear surface 150 may be oriented toward feed direction F or melting station 54 in FIG. 3.

Ink sticks may include a number of features that aid in correct loading, guidance, sensing and support of the ink stick when used. These features may comprise protrusions or indentations that are located in different positions on an ink stick for interacting with key elements, guides, supports, sensors, etc. located in complementary positions in the printer. For example, as shown in FIG. 4, the ink stick may include one or more key elements 154. The key elements interact with the keyed openings 60 of the loading station 50 to admit or block insertion of the ink sticks through the insertion opening 60 of the solid ink delivery system. The key elements 154 shown in the ink stick of FIG. 4 are vertical semi-cylindrical recesses or notches formed in the side surface 140, 144 of the ink stick body. The corresponding keys (not shown) on the perimeter of the keyed opening 60 are complementary protrusions into the key elements 154. Any number or shape of key elements may employed in any suitable position on the ink stick.

Each color for a printer may have a unique arrangement of one or more key elements in the outer perimeter of the ink stick to form a unique cross-sectional shape for that particular color ink stick. The combination of the keyed openings in the key plate of the printer and the key elements of the ink sticks generally insure and indicate that only ink sticks of the proper color are/should be inserted into the proper feed channel. A set of ink sticks is formed of an ink stick of each color, with a unique key element arrangement for ink sticks of each color.

Insertion keying may also be used to differentiate ink sticks intended for different models of printers. One type of insertion key may be placed in all the keyed openings of feed channels of a particular model printer. Ink sticks intended for that model printer contain a corresponding insertion key element. An insertion key of a different size, shape, or position may be placed in the keyed openings of the feed channels of different model printers.

The insertion keying features described above may aid in ensuring that an ink stick is inserted with the proper insertion orientation. However, these features are primarily exclusionary in that the insertion keying features act to exclude ink sticks from being inserted when oriented incorrectly. It is still possible for a customer, believing that s/he has correctly oriented an ink stick, to override the resistance caused by these insertion keying features and inadvertently force an incorrectly oriented ink stick through an insertion opening into a feed channel.

The ink sticks of the present disclosure comprise a retrieval feature located on the top surface 134. The retrieval feature is exposed to the user through the insertion opening, and has a vertical dimension that permits the user to grasp the retrieval feature between two fingers. The user can then extract or retrieve the ink stick through the insertion opening of the printer without the need for additional tools, and with sufficient clearance for the fingers. In particular, the insertion opening of the printer does not need to be designed to provide a clearance area for a retrieval tool.

As shown in FIG. 4, the retrieval feature 200 is formed from a first recess 210 and a second recess 220, both located in the top surface 134. The first and second recesses have opposing grasping surfaces 212, 222 that form a wall 225. Each recess extends into the ink stick from the top surface for a vertical dimension or depth D. The depth D is generally within the central portion 230 of the top surface 134. As shown here, each recess tapers from the central portion 230 to the top surface in a longitudinal direction (see FIG. 5). In use, one finger is placed on grasping surface 212, an opposing finger is placed on grasping surface 222, and the two fingers are pinched together against wall 225, allowing the ink stick 100 to be lifted in a vertical direction without interference from the shaped opening of the key plate on the printer. It should be noted that the wall 225 separates the first recess 210 and the second recess 220. As shown here, the retrieval feature 200 is located along a central portion 230 of the top surface 134. It should be noted that the top surface 134 still has space on wall 225 for the provision of identifying symbols, nomenclature, coded markings, etc.

As seen in FIG. 5, the retrieval feature 200 can also be described as being formed from a first lower surface 250 and a second lower surface 260. The first lower surface 250 has a first lower edge 252, and the second lower surface 260 has a second lower edge 262. An upper surface 270 is located between the first lower surface 250 and the second lower surface 260. The upper surface 270 may be part of the top surface 134, or may be below or above the top surface 134. The retrieval feature could also be described as being defined by a first riser surface 272 and a second riser surface 274. The first riser surface 272 extends from the first lower edge 252 to the top surface 134, and the second riser surface 274 extends from the second lower edge 262 to the top surface 134. The first and second riser surfaces may be angled, or in other words, the upper surface 270 may have a length 276 that is less than the distance 278 between first lower edge 252 and second lower edge 262. The angle θ may be determined from the vertical axis, or in other words based on the difference between the lengths 276 and 278. When the lengths 276 and 278 are equal, the angle θ is zero and is the vertical axis. In embodiments, the angle θ is at most 5° or at most 10°. This angled taper facilitates removal of the ink stick from its mold during the manufacturing process.

Figure 6:
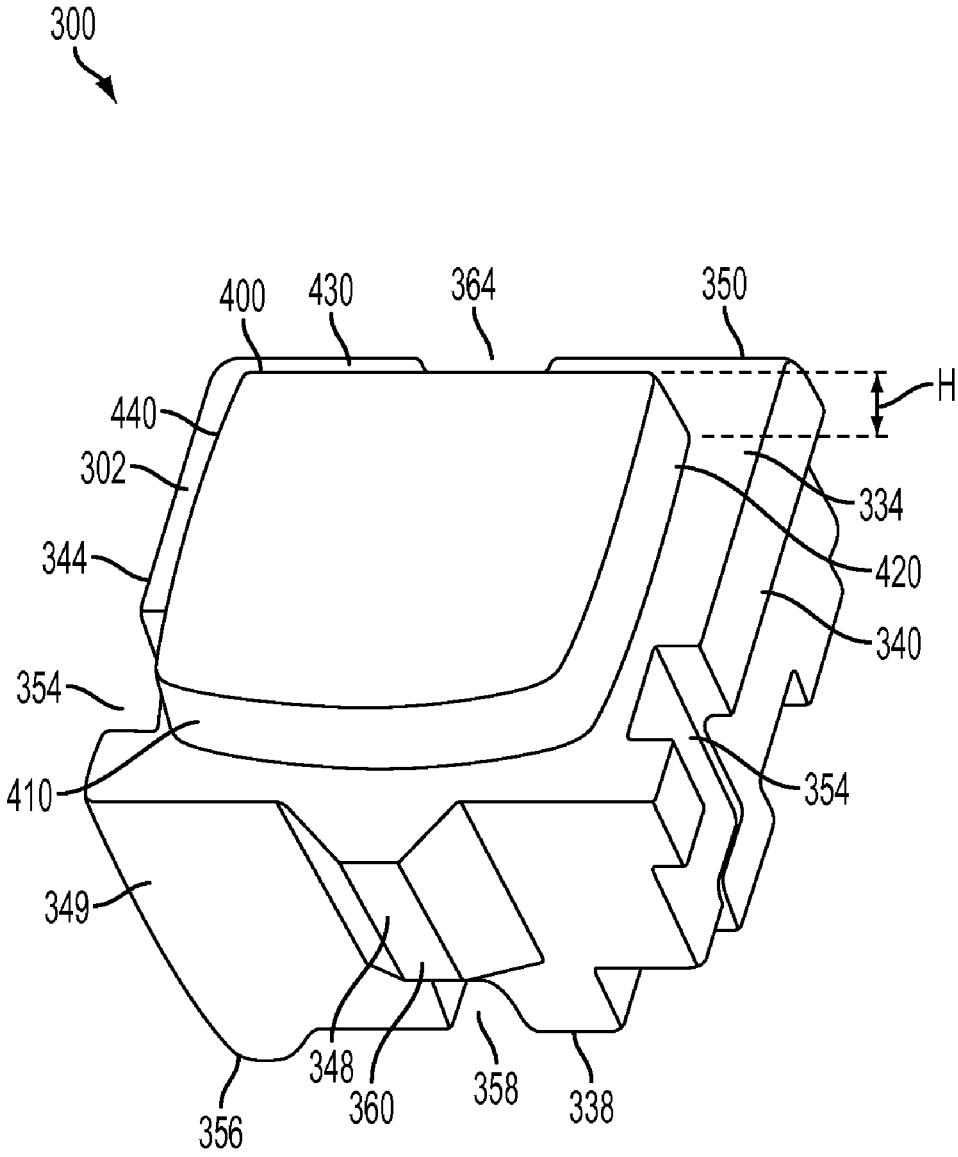
FIG. 6 is a top perspective view of another exemplary embodiment of a solid ink stick having a retrieval feature.
Figure 7:
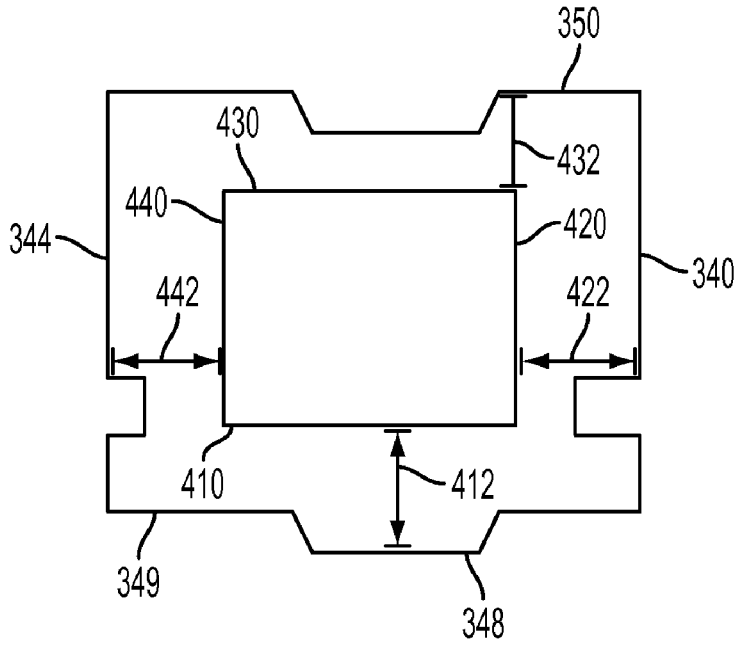
FIG. 7 is a top view of the exemplary ink stick shown in FIG. 6.
Figure 8:
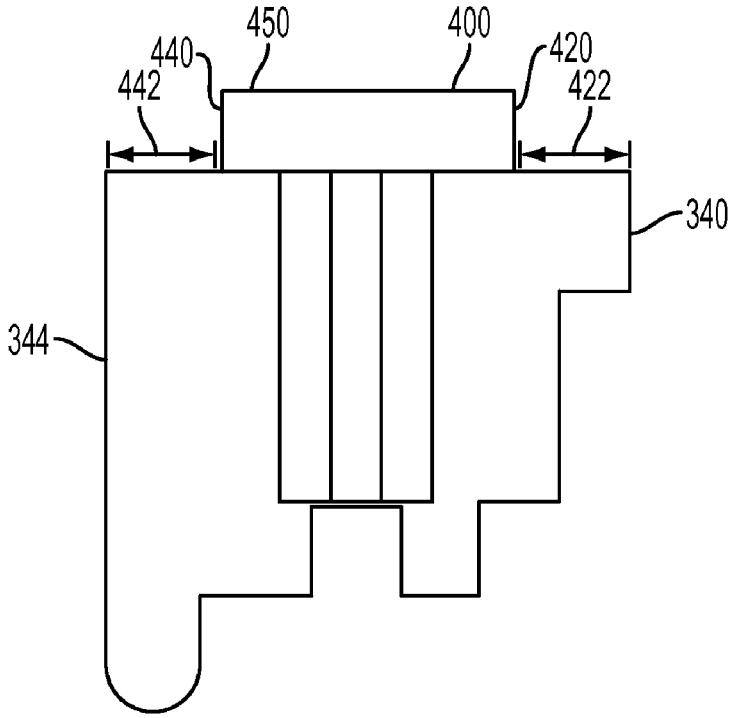
FIG. 8 is a front view of the exemplary ink stick shown in FIG. 6.

Another embodiment of an ink stick having a retrieval feature is shown in FIGS. 6-8. Ink stick 300 has an ink stick body 302. Again, the ink stick body 302 has a bottom surface 338, a top surface 334, two side surfaces 340, 344, a front surface 348, and a rear surface 350. The side surfaces 340 and 344 are substantially parallel to each other, and are substantially perpendicular to the top and bottom surfaces 334, 338. The front and rear surfaces 348, 350 are also basically substantially parallel to each other, and substantially perpendicular to the top and bottom surfaces, and to the side surfaces. The front surface 348 is shaped to form an intermediate surface 349 and a centrally positioned ridge 360, with the front portion of the ridge 360 being considered the front surface 348. Rear surface 350 has a centrally positioned recess 364, so that adjacent ink sticks can be interlocked. Again, the front and rear surfaces are not planar in this embodiment. Each side surface 340, 344 has a key element 354 for interacting with the keyed opening of the inkjet printer. As seen here, the bottom surface 338 is shaped, and contains for example a lower guide element 356 and a lower channel 358.

Here, the retrieval feature is a stem 400 that extends above the top surface 334 for a height or vertical dimension H. The stem 400 could also be considered as comprising four conjoining vertical faces 410, 420, 430, 440 that extend above the top surface for a vertical dimension H. The four conjoining vertical faces are spaced apart from the front surface 348, rear surface 350, and two side surfaces 340, 344 towards the center of the top surface 334.

In particular embodiments, the vertical dimension D, H is at least 6 millimeters (mm), including at least 10 mm, or from about 6 mm to about 30 mm. This vertical distance is sufficient to provide a graspable retrieval feature. In particular embodiments, the vertical dimension is about 7 mm. In additional embodiments, the retrieval feature is spaced at least 5 mm away from the front surface 348, rear surface 350, and the two side surfaces 340, 344 of the ink stick. The distances from these four surfaces are noted as reference numerals 412, 422, 432, and 442. This clearance distance is generally sufficient to permit two fingers to be passed through the opening 60 of the loading station of the printer 10, so that those fingers can be used to grasp the retrieval feature. Reference numeral 414 refers to the distance between intermediate surface 349 and the retrieval feature, and can be about 2 mm.

Generally, the retrieval feature may be considered as comprising two opposing faces that have a vertical dimension sufficient to permit the retrieval feature to be grasped between two fingers. In the embodiment of FIG. 4, the two opposing faces are labeled as opposing surfaces 212 and 222, or in FIG. 5 as first riser surface 272 and second riser surface 274. In the embodiment of FIG. 6, the two opposing faces could be vertical faces 410 and 430, or vertical faces 420 and 440. Again, the two opposing faces may extend from the top surface, or extend into the ink stick body from the top surface.

Ink sticks can be formed in many different sizes and shapes. In particular, many types of ink sticks are elongated, i.e. the distance between the front and rear surfaces of the ink stick (i.e. length) differs from the distance between the two side surfaces (i.e. width). It is contemplated that the dimensions of the retrieval feature can also differ. For example, the retrieval feature 200 of FIG. 4 has a length 290 and a width 280, and their distance differs. As desired, the length can be greater than the width, or vice versa.

Referring again to the ink stick of FIG. 4, the overall length of the ink stick may be about 125 mm, while the retrieval feature has a length 290 of about 100 mm. Similarly, the overall width of the ink stick may be about 34 mm, while the retrieval feature has a width 280 of about 20 mm. The length 276 of the upper surface 270 may be about 40 mm.

Referring now to the ink stick of FIG. 6, the ink stick has an overall width of about 44 mm and an overall length of about 40 mm. The width is measured between the two side surfaces 340, 344, while the length is measured between the front surface 348 and the rear surface 350.

The ink sticks of the present disclosure, along with their retrieval feature, can be manufactured using an injection molding or compression molding process, using methods known in the art. These processes allow the formation of ink sticks of nearly unlimited shapes with features on all surfaces.

As mentioned above, the ink stick body is formed from a composition comprising printing ink. The printing ink is generally a phase change ink, i.e. an ink that exists in the solid phase at ambient temperature, but exists in the liquid phase at an elevated operating temperature. Such phase change inks typically comprise an ink vehicle and a colorant.

Suitable ink vehicles can include paraffins, microcrystalline waxes, polyethylene waxes, ester waxes, fatty acids and other waxy materials, fatty amide containing materials, sulfonamide materials, resinous materials made from different natural sources (tall oil rosins and rosin esters, for example). Many synthetic resins, oligomers, polymers, and copolymers, and mixtures thereof can also be used, including ethylene/propylene copolymers; hydrocarbon-based waxes; urethane, urea, amide and imide derivatives of oxidized synthetic or petroleum waxes; isocyanate-derived resins and waxes; n-paraffinic, branched paraffinic, and/or aromatic hydrocarbons; high molecular weight linear alcohols; epoxy resins; Fischer-Tropsch waxes; polyvinyl alcohol resins; polyols; cellulose esters; cellulose ethers; polyvinyl pyridine resins; polysulfonamides; benzoate esters; phthalate plasticizers; citrate plasticizers; maleate plasticizers; polyvinyl pyrrolidinone copolymers; polyvinyl pyrrolidone/polyvinyl acetate copolymers; novolac resins; and natural product waxes, such as beeswax, montan wax, candelilla wax, GILSONITE (American Gilsonite Company), and the like; and linear long chain sulfones with from about 4 to about 16 carbon atoms.

The phase change ink also contains at least one colorant. As used herein, the term "colorant" includes pigments, dyes, mixtures of dyes, mixtures of pigments, mixtures of dyes and pigments, and the like. Any dye or pigment may be chosen, provided that it is capable of being dispersed or dissolved in the ink vehicle and is compatible with the other ink components. The colorant is present in the ink in any desired amount, typically from about 0.5 to about 20 percent by weight of the ink vehicle. Various pigments and dyes are known in the art.

As desired, other additives may be found in the phase change ink. Such additives may include dispersing agents or surfactants, antioxidants, UV absorbers, etc.

The retrieval feature may be located along the top surface of the ink stick and be sized so that the remaining space on the top surface can include additional information. For example, other orientation features may be provided to aid a user in visually identifying the ink stick and/or orienting the ink stick correctly for insertion. Also, other marks, such as brand names, logos, bar codes, or shop keeping units (SKUs) can be placed on the top surface.

While particular embodiments of the ink sticks of the present disclosure have been described, alternatives, modifications, variations, improvements, and substantial equivalents that are or may be presently unforeseen may arise to applicants or other skilled in the art. Accordingly, the appended claims as filed and as they are amended are intended to embrace all such alternatives, modifications, variations, improvements, and substantial equivalents.

What is claimed is:

1. An ink stick configured to be removable from the feed channel of an associated imaging device, the ink stick comprising:

an ink stick body having a top surface, a bottom surface, a front surface, a rear surface, and two side surfaces; and a retrieval feature within the top surface, the retrieval feature having a vertical dimension sufficient to permit the retrieval feature to be grasped between two fingers;

wherein the retrieval feature is formed by a first recess in the top surface and a second recess in the top surface, the first recess and the second recess having opposing grasping surfaces and extending into the top surface for the vertical dimension.

2. The ink stick of claim 1, wherein the retrieval feature is located along a central portion of the top surface.

3. The ink stick of claim 1, wherein the vertical dimension is a distance of at least 6 mm.

4. The ink stick of claim 1, wherein the retrieval feature comprises a first lower surface, a second lower surface, and an upper surface located between the first and second lower surface.

5. The ink stick of claim 1, wherein at least one of the side surfaces includes a key element which interacts with an associated printer to indicate whether the ink stick should be inserted into a particular feed channel of the printer.

6. The ink stick of claim 1, wherein the front surface and the rear surface have complementary interlocking shapes.

7. The ink stick of claim 1, wherein the first recess and the second recess each extend into a central portion of the top surface for the vertical dimension and taper towards the top surface in a longitudinal direction, the vertical dimension being at least 6 mm.

8. An ink stick configured to be removable from the feed channel of an associated imaging device, the ink stick comprising:

an ink stick body having a top surface, a bottom surface, a front surface, a rear surface, and two side surfaces; and a retrieval feature within the top surface, the retrieval feature having a vertical dimension sufficient to permit the retrieval feature to be grasped between two fingers, wherein the retrieval feature is spaced at least 5 mm away from the front surface, the rear surface, and the two side surfaces.

9. An ink stick configured to be manually removed from the feed channel of an associated ink printer, the ink stick comprising:

an ink stick body having a top surface; and a retrieval feature in the top surface, the retrieval feature comprising two opposing faces that have a vertical dimension sufficient to permit the retrieval feature to be grasped between two fingers;

wherein the retrieval feature is formed by a first recess in the top surface and a second recess in the top surface, the first recess and the second recess having opposing grasping surfaces and extending into the top surface for the vertical dimension:

wherein the first recess and the second recess each taper from the vertical dimension in a central portion of the top surface to the to surface in a longitudinal direction.

10. The ink stick of claim 9, wherein the vertical dimension is at least 6 mm.

11. The ink stick of claim 9, wherein the retrieval feature further comprises an upper surface joining the two opposing faces.

12. The ink stick of claim 9, wherein the two opposing grasping surfaces are angled at least 5° from a vertical axis.

* * * * *